33-241 SR
8/5/80 XR 4,215,484

United States Patent [19]
Lauffenburger

[11] 4,215,484
[45] Aug. 5, 1980

[54] AIMING DEVICE FOR ARCHERY BOWS AND OTHER OBJECTS

[76] Inventor: Robert F. Lauffenburger, 726 Cobham Park Rd., Warren, Pa. 16365

[21] Appl. No.: 958,418

[22] Filed: Nov. 7, 1978

[51] Int. Cl.[2] ..... F41G 1/46
[52] U.S. Cl. ..... 33/265; 33/241
[58] Field of Search ..... 33/241, 265, 252

[56] References Cited

U.S. PATENT DOCUMENTS

| | | | |
|---|---|---|---|
| 529,424 | 11/1894 | Von Skoda | 33/241 |
| 2,504,115 | 4/1950 | Dickison | 33/241 |
| 3,266,149 | 8/1966 | Powell | 33/265 |
| 3,488,853 | 1/1970 | Altier | 33/265 |
| 4,142,297 | 3/1979 | Altier | 33/265 |

*Primary Examiner*—William D. Martin, Jr.
*Attorney, Agent, or Firm*—LeBlanc, Nolan, Shur & Nies

[57] ABSTRACT

An aiming device comprising a sight-supporting base adapted to be detachably secured to the central portion of the bow or a part of some other object, a rear sight positioned on the base, a light-emitting front sight, a member mounting the front sight on the base and being manually displaceable for adjusting the elevation of the front sight, and an adjusting screw and leveling pad arrangement for adjusting the base to a position where the line of aim established along the front and rear sights lies in a plane extending parallel to the bow and containing the longitudinal axis of an arrow in shooting position on the bow.

16 Claims, 6 Drawing Figures

AIMING DEVICE FOR ARCHERY BOWS AND OTHER OBJECTS

FIELD OF INVENTION

This invention relates to aiming or sighting devices for archery bows and other objects.

BACKGROUND

Various archery bow sighting devices have been proposed in the past such as the ones described in U.S. Pat. No. 3,945,127 which issued to Phillip G. Spencer on Mar. 23, 1976, U.S. Pat. No. 3,368,282 which issued to D. E. Gibson et al on Feb. 13, 1968, U.S. Pat. No. 3,450,122 which issued to C. Diamond on June 17, 1969, U.S. Pat. No. 3,058,221 which issued to W. R. McNeel on Oct. 16, 1962, U.S. Pat. No. 2,642,661 which issued to B. E. Fredrickson on June 23, 1953 and U.S. Pat. No. 2,542,501 which issued to B. E. Frederickson on Feb. 20, 1951.

Some of the prior archery bow sighting devices, such as the ones shown in U.S. Pat. Nos. 2,542,501 and 2,642,661, are not suitable for attachment to existing bows of standard construction. Others such as the one shown in U.S. Pat. No. 3,368,282 tend to be bulky and relatively expensive and have numerous parts. Another problem experienced with detachable archery bow sights is that of adjustment for properly aligning the sight with the bow and the arrow in shooting position on the bow.

Except for the construction shown in U.S. Pat. No. 3,941,127 the sighting devices described in the foregoing patents do not provide for the illumination of the front sight to enable the front sight to be easily located or seen for accurate aiming particularly in poor lighting conditions. The aiming device disclosed in U.S. Pat. No. 3,945,127, however, has a number of drawbacks detracting from the advantage of the illuminated front sight.

For example, the sighting device shown in U.S. Pat. No. 3,945,127 is relatively expensive and tends to be bulky. Furthermore, it does not have a rear sight for accurate aiming. Still further, it does not provide for the quick and easy vertical adjustment of the front sighting element and requires a tool such as a screwdriver for making vertical adjustments.

The present invention has none of the foregoing drawbacks and additionally incorporates unique features that are usable with or without an illuminated front sight. Furthermore, the aiming device of this invention is applicable to other devices such as rifles and can also be used for aiming various other objects, as a surveyor's instrument. Additionally, it can be used to aim vehicles, such as a bulldozer, for movement along a straight path.

SUMMARY AND OBJECTS OF INVENTION

The aiming device of this invention is particularly suitable for use with an archery bow and mainly comprises a sight-supporting plate or base, a light-emitting front sight unit mounted on the sight-supporting plate, and a leveling plate or pad. The assembly of the sight-supporting plate and the leveling plate is detachably secured by screws to the central portion of the bow on one side thereof. A special adjusting screw arrangement coacting with the leveling plate is used to accurately align the supporting plate and sight assembly on the bow.

In the illustrated embodiment the front sight unit comprises a small incandescent sighting bulb positioned on the front sight at the upper end of a sight post. The sight post is threadedly mounted on the sight-supporting plate for adjusting the height or elevation of the front sight. A battery furnishing the electrical power for illuminating the front sight bulb is housed in a recess of a cap which is detachable threaded onto the lower end of the sight post. The sight post is tubular or hollow to receive a conductor which connects the battery to the bulb. The battery may be of any suitable, commercially available type and is easily replaceable simply by detaching the screw cap from the sight post. In place of a light-emitting bulb the front sight may be in the form of a pin or the like which is coated with a fluorescent or luminous material to emit light.

Apart from the front sight unit and the mounting and adjustment screws mentioned above, the only parts of the aiming device of this invention are the sight-supporting and leveling plates themselves, each of which is of rugged one-piece construction. The aiming device of this invention therefore has relatively few parts and is of efficiently organized, simplified, inexpensive construction.

Furthermore, the aiming device of this invention is easily and quickly attachable to the archery bow without requiring any significant modification to the bow itself. It also is lightweight and can be used with virtually any bow design. Additionally, it affords an unobstructed view of the target and the area around the target.

With the foregoing in mind, it is the general aim and purpose of this invention to provide a novel aiming or sighting device which can easily be attached to virtually any make or design of bow and which can also be used to aim other objects such as a surveyor's instrument.

Another important object of this invention is to provide a novel aiming or sighting device of lightweight, efficiently organized, inexpensive construction.

Still another object of this invention is to provide a novel sighting or aiming device having a unique adjustment for accurately aligning the support plate and sight assembly with respect to the bow and the shooting position of the arrow.

Still another object of this invention is to provide a novel sighting or aiming device having a unique light-emitting front sight unit to make the front sight more visible in the dark or under poor lighting conditions.

Further objects of this invention will appear as the description proceeds in connection with the appended claims and the below-described drawings.

DETAILED DESCRIPTION

Figures 1, 2, 3:
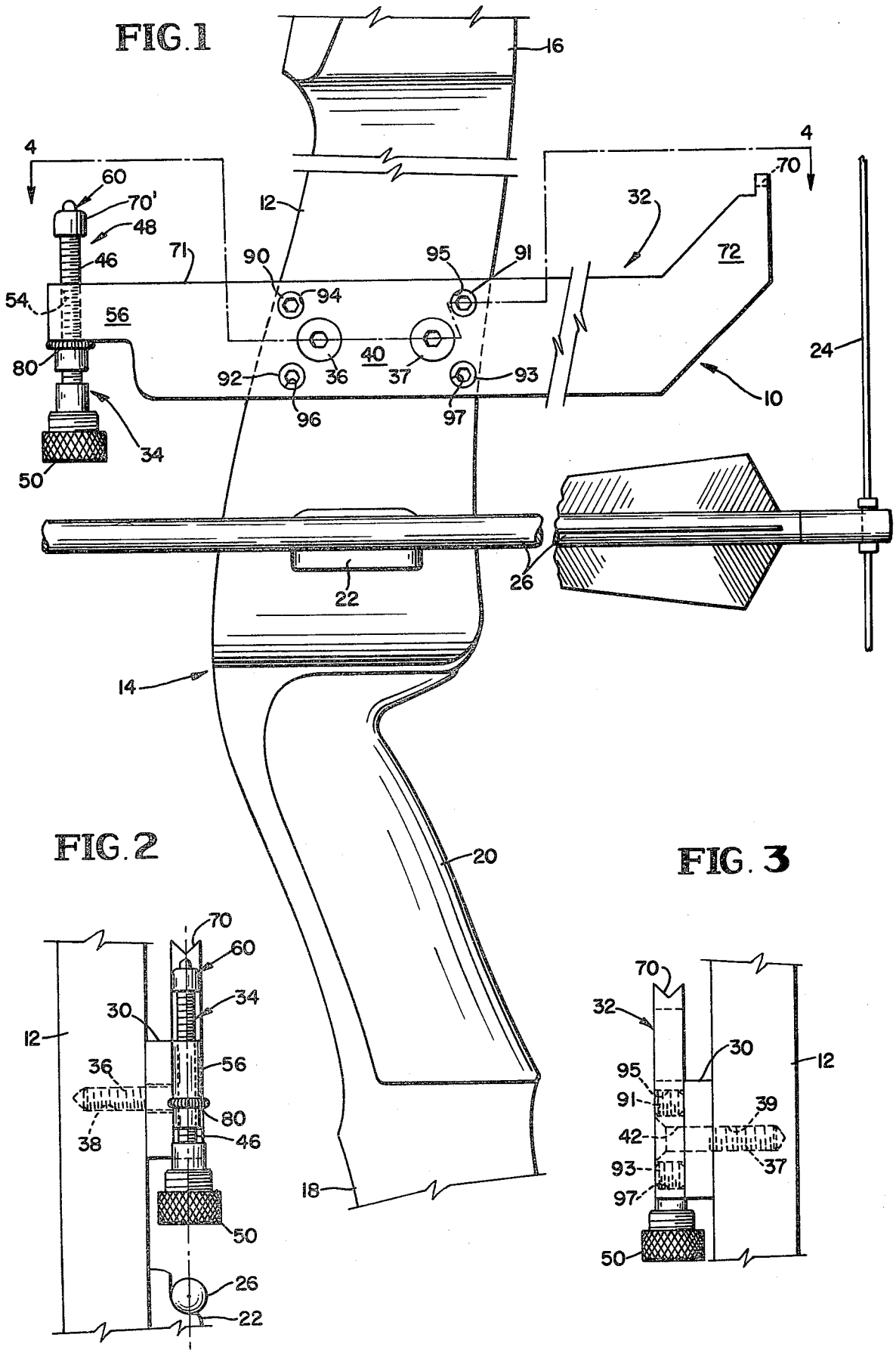
FIG. 1 is a side elevation showing the aiming device of this invention attached to an archery bow for use therewith.
FIG. 2 is a front elevation of the assembly of the aiming device and bow shown in FIG. 1.
FIG. 3 is a rear elevation of the assembly of the aiming device and bow shown in FIG. 1.

Referring to FIG. 1 the aiming device incorporating the principles of this invention is generally indicated at 10 and is shown to be detachably secured to the central portion or section 12 of a conventional archery bow 14 having the usual upper and lower flexible portions 16 and 18. The central section 12 of the archery bow extends between and is joined to the upper and lower portions 16 and 18 as shown. Bow section 12 is formed with a handgrip 20 below an arrow rest 22. A bowstring 24 mounted on the bow is shown to be in engagement with the nocked end of an arrow 26 seated on the arrow rest 22.

In the illustrated embodiment the aiming device of this invention mainly comprises a flat-sided one-piece leveling plate 30 or pad, a flat-sided one-piece sight-supporting plate 32, and a front sight unit 34 adjustably mounted on the forwardly facing end of plate 32. The subassembly of plates 30 and 32 is detachably fixed to the bow section 12 above arrow rest 22 by a pair of mounting screws 36 and 37. Screws 36 and 37 may be of the flat-headed allen wrench type. Plates 30 and 32 may advantageously be formed from lightweight aluminum.

Figure 4:
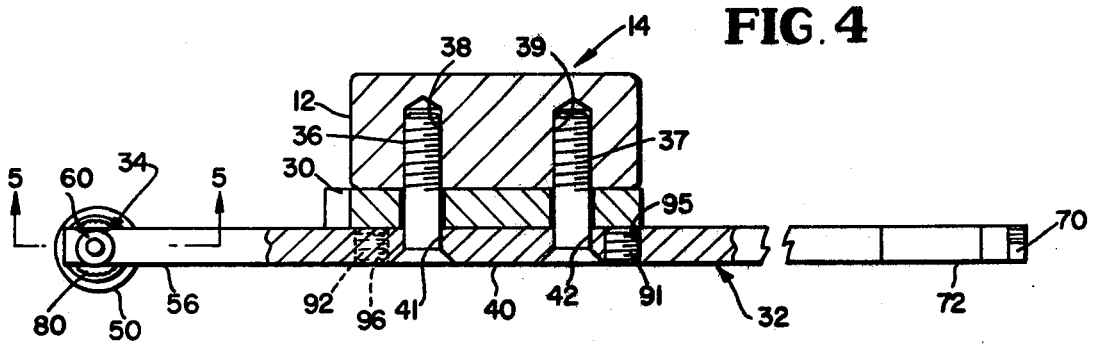
FIG. 4 is a section taken substantially along lines 4—4 of FIG. 1.

As shown in FIG. 4, screw 36 extends through aligned smooth walled bores in plates 30 and 32 and is threaded into a blind tapped bore 38 which is formed in the left-hand side of the bow section 12. Screw 37 similarly extends through aligned smooth walled bores in plates 30 and 32 and is also threaded into a blind tapped bore 39 in bow section 12. The formation of bores 38 and 39 is the only bow modification required for detachably mounting the aiming device of this invention on the bow.

As shown, the longitudinal axes of bores 38 and 39 and hence of screws 36 and 37 lie in a common plane normally intersecting bow section 12. The bores formed through plate 32 for receiving screws 36 and 37 are indicated at 41 and 42 in FIG. 5 and may be countersunk as shown to receive the heads of the mounting screws. Bores 41 and 42 are formed through a generally rectangular body portion 40 of plate 32 as shown. The longitudinal axes of bores 41 and 42 are parallel and lie in a common plane which extends medially between the upper and lower straight parallel edges of the body portion 40.

Figure 5:
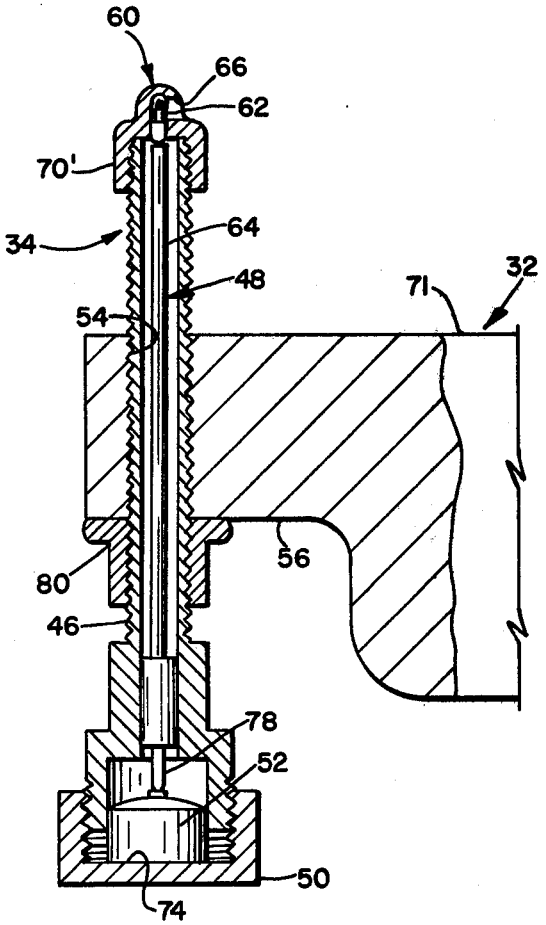
FIG. 5 is an enlarged section taken substantially along lines 5—5 of FIG. 4.
Figure 6:
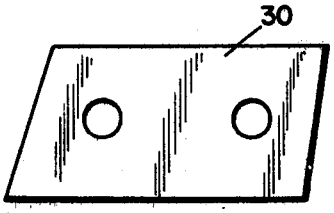
FIG. 6 is a left-hand side elevation of the leveling plate shown in FIGS. 2–4.

In the illustrated embodiment, which is particularly adapted for right-hand bows, leveling plate 30 is positioned between bow section 12 and the sight-supporting plate 32 and has a flat side face which seats against the left-hand side face of bow section 12 as best shown in FIG. 5. Plate 32 extends or projects both forwardly and rearwardly of bow section 12.

Referring to FIGS. 1, 2 and 5, front sight unit 34 is of compact, efficiently organized construction and mainly comprises a hollow or tubular, externally threaded metal sight post 46, a sight and electric light assembly 48, a metal screw cap 50 and a battery 52. Sight post 46 is threaded upwardly through a tapped bore 54 in plate 32. Bore 54 is formed through a forwardly projecting end portion 56 of plate 32 along an axis that normally intersects a plane containing the axes of bores 41 and 42. End portion 56 is disposed forwardly of the body portion 40 and also forwardly of the central bow section 12 such that front sight unit 34 is spaced forwardly of the forwardly facing edge of bow section 12 as best shown in FIG. 1. When bow 14 is held in its normal upright position as shown in FIG. 1, sight post 46 will be in an upright, essentially vertical position. Post 46 extends above and below the end portion 56 of plate 32 as shown.

Referring to FIG. 5, the sighting element and light assembly 48 comprises a metal sighting element 60, an electric light or bulb 62, and an elongated compression type electrically conductive contact element 64. Sighting element 60 terminates at its upper end in a rounded sighting head 68 and has an internally threaded depending annular skirt portion 70'. The upper end of sight post 46 is threaded into skirt portion 70' such that the sighting element 60 receives and covers the upper end portion of post 46. Sighting element 60 is therefore disposed at a level that is spaced above the upper straight edge 71 of the support plate portions 40 and 56.

As best shown in FIG. 5, bulb 62 is mounted in the head of sighting element 60 and registers with a lateral aperture 66 which is formed in the head of sighting element 60 just below the rounded top of the sighting head. When energized, bulb 62 thus emits a beam of light through aperture 66. For normal operation sighting post 46 is adjusted to a position where the beam of light emitted by bulb 62 through aperture 66 aligns with and passes medially through a V-shaped rear sight 70. In this operating position of front sight unit 34, bulb 62 is shielded by sighting element 60 in such a way that bulb 62 cannot be seen at a position located forwardly of bow 14. Sight 70 is integrally formed with and projects upwardly from a rearwardly extending end portion 72 of the sight-supporting plate 32.

The rearward end portion 72 of plate 32 is canted upwardly from the remainder of plate 32 such that the notched rear sight 70 is at a level and on a line of sight disposed above the support plate's upper edge 71.

Still referring to FIG. 5, screw cap 50 receives and is detachably threaded onto the lower end of sight post 46. Cap 50 is formed with an inner recess 74 which opens axially into the adjacent stepped bore portion of post 46. Battery 52 may be of any suitable type such as the disc configuration used in hearing aids and is removably seated in recess 74. As shown, battery 52 extends into the lower stepped bore portion 76 of post 46.

Contact element 64 is connected to one terminal or electrode of bulb 62 at its upper end and extends coaxially through the internal bore of sight post 46 in spaced apart relationship thereto. At the lower end of sight post 46 element 64 terminates in a tip 78 which contacts the central electrode of battery 52. Cap 50 is threaded on post 46 to a position where it is finger tight to thus establish firm electrical contact between the tip 78 of contact element 64 and the central electrode or terminal of battery 52. The other terminal or electrode of bulb 62 is connected to sighting element 60 to establish a circuit connection through post 46 to the outer terminal or electrode of battery 52. In illustrated position of parts an electrical circuit is therefore completed for conducting current through bulb 62.

From the foregoing description of the front sight unit 34 it will be appreciated that the sighting element 60 is vertically adjustable along the axis of bore 54 by manually threading sight post upwardly or downwardly as desired along bore 54. The enlarged lower end of sight post 46 is conveniently located to provide for the hand-manipulated threaded adjustment of sight post 46 without the use of tools of any kind.

A lock nut 80 is threaded on sight post 46 and is tightened against the bottom edge of the support plate's end portion 56 to lock sight post 46 in its adjusted position. Vertical and rotational adjustment of sight post 46 accurately positions and aligns the front sighting head 68 and the beam of light emitted by bulb 62 with respect to the rear sight 70. This adjustment may also be used for varying the trajectory of the arrow.

From the foregoing description it will be appreciated that the beam of light emitted by bulb 62 enables the front sighting element 60 to be quickly and easily located in the dark or in poor lighting conditions. Bulb 62 may be of any color to suit the eye and light conditions.

Bulb 62 may be turned off simply by hand loosening cap 50 to a position where the contact end 78 no longer contacts or seats on the central terminal of battery 52.

Removal or replacement of battery 52 is accomplished by simply removing or unthreading cap 50 from sight post 46. If bulb 62 burns out, assembly 48 is replaceable as a unit simply by unthreading the existing assembly from sight post 46.

Four adjusting screws 90, 91, 92 and 93 are provided for properly positioning the assembly of plate 32 and front sight unit 34 on bow 14. As will be described in detail below, screws 90–93 are arranged to provide a combined angular or tilting and rectilinear adjustment of the assembly of plate 32 and the front and rear sights thereon.

As shown, screws 90–93 are threaded through tapped bores 94, 95, 96 and 97, respectively. Bores 94–97 are formed through the body portion 40 of plate 32 along parallel spaced apart axes.

The axes of bores 94–97 and hence the axes of the adjusting screws 90–93 are located at the corners of a rectangle. With this arrangement the plane containing the longitudinal axes of bores 94 and 95 is parallel to a plane containing the axes of bores 96 and 97 and is also parallel to a plane containing the axes of bores 41 and 42. Additionally, a plane containing the axes of bores 94 and 96 is parallel to a plane containing the axes of bores 95 and 97. The plane containing the axes of bores 41 and 42 lies midway between two planes, one containing the axes of bores 94 and 95 and the other containing the axes of bores 96 and 97. Bores 41 and 42 also lie between the plane containing the axes of bores 94 and 96 and the plane containing bores 95 and 97.

Adjusting screws 90–93 are threaded through their respective bores 94–97 to positions where they seat against the flat side of leveling plate 30 that lies adjacent to the sight-supporting plate 32. Screws 90–93 may be of any suitable type and preferably are of the cup point type which terminate in an annular edge or lip for non-rocking seating engagement against the adjacent flat side face of leveling plate 30. Screws 90–93 may be of the Allen head type. The outer ends of bores 94–97 may be countersunk to receive the heads of screws 90–93.

When the mounting screws 36 and 37 are loosened, plate 32 together with the sights positioned thereon may be adjusted as a unit laterally of the cental bow section 12. This is accomplished by threading all four of the adjusting screws 94–97 inwardly towards leveling plate 30 or by threading all four of the adjusting screws outwardly in the opposite direction. In this manner plate 32 is bodily shiftable or reciprocable along a line that may extend parallel to the axes of bores 38 and 39.

In addition to the foregoing rectilinear adjustment, screws 90–93 provide a plural-way tilting or pivotal adjustment of plate 32 about mutually perpendicular axes. For example, the upper edge of plate 32 may be tilted relative to a vertical plane (i.e., a plane normally intersecting bores 38 and 39) by threading screws 90 and 91 in one direction and by threading screws 92 and 93 in the opposite direction or by just threading screws 90 and 91 in a common direction. Alternatively, the forward edge of plate 32 may be swung relative to the vertical plane mentioned above by threading screws 91 and 93 in a common direction. Still further, the rearward edge of plate 32 may be swung relative to the vertical plane mentioned above by threading screws 90 and 92 in a common direction.

By adjusting screws 90–93 in varying combinations it therefore will be appreciated that plate 32 is selectively pivotal about either one or both of two transversely or normally intersecting pivot axes, one extending horizontally and the other extending vertically when bow 14 is in its illustrated upright position. Both of these pivot axes lie in a plane normally or transversely intersecting the axes of bores 94–97 and extending longitudinally of bow 14 rather than transversely of the bow. In other words both of these pivot axes extend transversely with respect to the axes of bores 94–97 and also with respect to a line transversely intersecting or extending laterally of the central bow section 12.

Adjustment of screws 90–93 thus has the effect of canting plate 32 in a horizontal plane and/or a vertical plane as well as bodily shifting plate 32 laterally of bow section 32 (i.e., along a line parallel to bores 38 and 39). In this manner the line of aim established along the front and rear sights 60 and 70 may accuately be located in a plane containing the axis of arrow 26 in its shooting position and extending parallel to bow 14. In other words, when bow 14 is held in its normal upright or vertical position shown in FIG. 1, the axis of arrow 26 and the line of aim along sights 60 and 70 will lie in a common vertical plane. This adjustment together with the height or elevation adjustment of the frong sight or sighting element 60 thus assures accurate aiming.

After the adjustments are made with screws 90–93, mounting screws 36 and 37 are tightened to secure or clamp the assembly of plate 32 and screws 90–93 in place against the side of leveling plate 30 to thereby firmly fix plate 32 in its adjusted position. When screws 36 and 37 are tightened plate 30 will be clamped in place between the side of bow section 12 and the ends of screws 90–93. In its adjusted position, plate 32 may be spaced from and/or canted with respect to plate 30. The mounting and adjusting screw clearances in plate 32 are large enough to permit the foregoing adjustments.

From the foregoing description it will be appreciated that the aiming or sighting device of this invention is of compact, simplified, efficiently organized, inexpensive construction. Additionally, it affords an unobstructed view of the target and the region or area around the target. Furthermore, it is of lightweight, well balanced construction having unique, easily manipulatable adjustments as well as providing for a light-emitting front sight to enable the front sight to be easily located and viewed in the dark or in poor lighting conditions.

From the foregoing description it also will be appreciated that the sight-supporting plate 32, or sight-supporting base as it may be called, is elongated in a direction to position the front sight 60 forwardly of bow section 12 and the rear sight 70 rearward of bow section 12. Finally, it will be noted that mounting screws 36 and 37 are arranged to prevent rotational or pivotal motion of plate 32 and an axis extending parallel to the axes of bores 41 and 42.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An aiming device for an archery bow or other object comprising a sight-supporting base, fastening means adapted to secure said base to a portion of said bow or said object, front and rear sights positioned on said base, and adjusting means providing for the non-pivotal displacement of said base laterally of said bow or object and also providing for the pivotal displacement of said base about each one of two mutually transverse axes which lie in a plane extending longitudinally of said bow, said fastening means comprising a plurality of first threaded members adapted to be threaded into the central section of said bow above the bow's handgrip to provide for the attachment of said base to said central section on one pre-selected side thereof, said adjusting means comprising a rigid member positioned between said base and said one pre-selected side of said central section, and a plurality of second threaded members mounted on said base for individual selective displacement relative thereto and coacting with said rigid member to provide for the adjustment of said base relative to said rigid member and said central section.

2. The aiming device defined in claim 1, there being four of said second threaded members arranged in spaced apart parallel relation and threaded through internally threaded holes in said base to abut the side of said rigid member facing said base.

3. The aiming device defined in claim 2 wherein said first threaded members extend through unthreaded holes in said base and said rigid member.

4. The aiming device defined in claim 3 wherein said rigid member is clamped in place between said one pre-selected side of said central section and corresponding ends of said second threaded members.

5. The aiming device defined in claim 4 wherein said base is a one-piece plate and wherein said rigid member is also a one-piece plate.

6. The aiming device according to any one of the preceding claims 1 and 2–5 comprising manually manipulatable means displaceably mounting said front sight on said base for selectively adjusting the elevation of said front sight relative to said rear sight.

7. The aiming device according to any one of the preceding claims 1 and 2–5 comprising light emitting means carried by said front sight.

8. The aiming device defined in claim 1 including means displaceably mounting said front sight on said base and comprising a selectively manipulatable elongated threaded member extending upwardly from said base and threadedly engaged in said base for threaded adjustment along an axis extending transversely of the line of aim established along said front and rear sights, said front sight comprising a sighting element detachably threadedly mounted on the upper end of said elongated member, and said aiming device further comprising an electric light carried by said sighting element for emitting light than can be seen by a person looking along said line of aim from behind said rear sight, a battery supporting member detachably secured to the lower end of said elongated member, a battery carried by said battery supporting member and electrical conductor means interconnecting said battery and said electric light, said elongated member being tubular and receiving said electrical conductor means.

9. An aiming device for an archery bow or other object comprising a sight-supporting base, means adapted to attach said base to said bow or said object, and a sight unit comprising an elongated tubular member mounted on said base and extending upwardly therefrom, a sighting element positioned on the upper end of said member, an electric light carried by said sighting element for emitting light which enables said sighting element to be located by the user of said bow or object in the dark or under poor lighting conditions, a battery-supporting member detachably secured to the lower end of said elongated member, a battery removably seated in said battery-supporting member, and electrical conductor means extending at least partially through the hollow interior of said elongated member for electrically interconnecting said battery and said electric light.

10. The aiming device defined in claim 9 wherein said battery-supporting member is formed with a recess receiving said battery and opening into the hollow interior of said elongated member, said battery-supporting member being displaceably mounted on said elongated member between a first position where a terminal on said battery makes contact with said electrical conductor means to complete a circuit for energizing said light and a second position where said terminal is out of contact with said electrical conductor means to de-energize said light.

11. The aiming device according to claims 9 or 10 wherein said sighting element has a head positioned to define a front sight, wherein a rear sight is positioned on said base rearwardly of said front sight, wherein said elongated member is selectively displaceable along its longitudinal axis for adjusting the elevation of said front sight relative to said rear sight, and wherein said sighting element is detachably mounted on said elongated member to facilitate the removal of said sighting element and said electric light as a unit.

12. An aiming device for an archery bow comprising a sight-supporting base, sight means positioned on said base to establish a line of aim, fastening means adapted to detachably secure said base to the central section of said bow on one pre-selected side thereof, a leveling pad confined between said base and said one pre-selected side of said central section, and a plurality of adjusting members mounted on said base in parallel spaced relationship and extending at corresponding ends laterally beyond said base to abut against the side of said pad facing said base without being attached to said pad, said adjusting members being individually and selectively displaceable along their parallel spaced apart axes for adjusting said base to a position where said line of aim lies in a plane extending parallel to said bow and containing the longitudinal axis of an arrow in shooting position on said bow.

13. The aiming device defined in claim 12 there being four of said adjusting members arranged in parallel spaced apart relationship for displacement along axes extending transversely of said base and said pad to provide for the non-pivotal lateral displacement of said base relative to said pad and said central section and also to provide for the pivotal displacement of said base about horizontal and vertical axes.

14. An aiming device for an archery bow comprising a sight-supporting base, fastening means adapted to secure said base to a portion of said bow, front and rear sights positioned on said base, and adjusting means providing for the non-pivotal displacement of said base laterally of said bow and also providing for the pivotal displacement of said base about each one of two axes, which axes respectively extend at least approximately horizontally and vertically when the bow is in an upright, shooting position, said adjusting means comprising a plurality of adjusting members positioned on said base and being manually displaceable to provide for the non-pivotal displacement of said base laterally of said bow, the pivotal displacement of said base about the horizontally extending axis, and the pivotal displacement of said base about the vertically extending axis.

15. The aiming device defined in claim 14 wherein pre-selected ones of said adjusting members are manually displaceable to enable said base to be laterally displaced relative to said bow without pivoting said base about either of said two axes, to enable said base to be pivotally displaced about the horizontally extending axis without pivotally displacing the base about the vertically extending axis and without laterally displacing the base, and to enable said base to be pivotally displaced about the vertically extending axis without pivoting the base about the horizontally extending axis.

16. The aiming device defined in claims 14 or 15 wherein said adjusting members are threaded and are threaded in tapped apertures in said base for manual displacement along parallel spaced apart axes.

* * * * *